US008405553B2

(12) United States Patent
Pintos et al.

(10) Patent No.: US 8,405,553 B2
(45) Date of Patent: Mar. 26, 2013

(54) COMPACT ANTENNA SYSTEM WITH A DIVERSITY ORDER OF 2

(75) Inventors: Jean-Francois Pintos, Bourgbarre (FR); Philippe Minard, Saint Medard sur Ille (FR); Jean-Luc Le Bras, Rennes (FR)

(73) Assignee: Thomson Licensing, Issy les Moulineaux (FR)

( * ) Notice: Subject to any disclaimer, the term of this patent is extended or adjusted under 35 U.S.C. 154(b) by 325 days.

(21) Appl. No.: 12/660,383

(22) Filed: Feb. 25, 2010

(65) Prior Publication Data

US 2010/0220015 A1 Sep. 2, 2010

(51) Int. Cl.
*H01Q 1/38* (2006.01)

(52) U.S. Cl. ..... 343/700 MS

(58) Field of Classification Search ..... 343/700 MS, 343/702, 767, 770, 725
See application file for complete search history.

(56) References Cited

U.S. PATENT DOCUMENTS

| | | | | |
|---|---|---|---|---|
| 6,686,886 | B2 * | 2/2004 | Flint et al. | 343/702 |
| 6,957,080 | B2 * | 10/2005 | Guetre et al. | 455/552.1 |
| 7,084,814 | B2 * | 8/2006 | Chen et al. | 343/700 MS |
| 7,298,335 | B2 * | 11/2007 | Usui et al. | 343/702 |
| 7,460,069 | B2 * | 12/2008 | Park et al. | 343/700 MS |
| 7,535,422 | B2 * | 5/2009 | Liu et al. | 343/702 |
| 7,796,085 | B2 * | 9/2010 | Fujii | 343/700 MS |
| 2001/0043159 | A1 * | 11/2001 | Masuda et al. | 343/700 MS |
| 2007/0132651 | A1 * | 6/2007 | Nilsson | 343/781 P |
| 2007/0146210 | A1 * | 6/2007 | Hilgers | 343/702 |
| 2007/0229366 | A1 * | 10/2007 | Kim et al. | 343/700 MS |
| 2009/0073047 | A1 * | 3/2009 | Le Bolzer et al. | 343/700 MS |
| 2009/0189828 | A1 * | 7/2009 | Shmulevich et al. | 343/876 |
| 2011/0309893 | A1 * | 12/2011 | Kawamura et al. | 333/104 |

* cited by examiner

*Primary Examiner* — Huedung Mancuso
(74) *Attorney, Agent, or Firm* — Tutunjian & Bitetto, P.C.

(57) ABSTRACT

The present invention relates to a very compact antenna system with a diversity order of 2. An antenna system with a diversity order of 2 integrated on an electronic card comprising a first radiating element of F-inverted type with a first extremity connected to a ground plane, a second extremity free and a conductive power supply part, a second radiating element of F-inverted type with a first extremity connected to a ground plane, a second extremity free and a conductive power supply part, characterized in that the free extremities of the first and second radiating elements are opposite one another and are separated by a projecting element of the ground plane.
Application in electronic cards for multi-standard communication devices.

4 Claims, 6 Drawing Sheets

COMPACT ANTENNA SYSTEM WITH A DIVERSITY ORDER OF 2

This application claims the benefit, under 35 U.S.C. §119 of French Patent Application 0951272, filed Feb. 27, 2009.

The present invention relates to a compact antenna system with a diversity order of 2, more specifically to an antenna system for wireless communication devices such as multi-standard digital platforms or gateways.

BACKGROUND OF THE INVENTION

The digital platforms or gateways currently on the market propose multi-services via wireless links. They must therefore be able to support diverse standards such as the standards for digital telephone communications implementing the DECT (Digital Enhanced Cordless Telephone) function or the standards for high bitrate wireless communications such as the IEEE802.11a, b, g standards.

Moreover, this type of wireless communication is sometimes carried out inside a premise and, in this case, multiple paths phenomena are observed that are very penalising for the quality of the signal received, particularly the interference phenomena that provoke a fading of signals.

To overcome the above problems, antenna systems with a diversity order of 2 are used. However to obtain correct diversity, it is necessary that the two antennas are perfectly decorrelated. Hence, those skilled in the art have a tendency to space out the antennas from each other. However, the wireless communication devices, currently on the market, are more and more compact, which poses a problem with respect to the location of antennas realised directly on the electronic card receiving the other processing circuits.

Various solutions have been proposed to overcome the disadvantages mentioned above. Thus, in the patent application WO2007/006982 in the name of THOMSON Licensing, it has been proposed to integrate two F-inverted type antennas back to back on an electronic card. To improve the decoupling between the two F-inverted type antennas, a slot of length λg/4 is preferably provided. An antenna system of this type is shown in FIG. 1.

SUMMARY OF THE INVENTION

In this case, on a substrate 1 with a ground plane 2, are etched two F-inverted type antennas 3 and 4. The antennas 3 and 4 in the embodiment shown, are positioned along the periphery of the substrate 1 being perpendicular to one another. They are connected by their extremities 3', 4' forming a ground while the free extremities 3", 4" each open out onto a part of the substrate respectively A, B that is non-metallized.

In this case, the extremities 3' and 4' are connected to the ground plane 2 and in the embodiment shown, a slot 5 is provided to improve the decoupling between the two antennas. Each antenna 3 and 4 is connected respectively by a feed line 3*a* and 4*a* respectively matched at 50 ohms to a feed port 3*b*, 4*b*.

This antenna system has good isolation between the two radiating elements. However, it requires a clearance area A, B in front of the radiating element. This area A, B must not comprise any metallic parts so that the antenna operates in the correct conditions.

The present invention therefore relates to an antenna system with a diversity order of 2 that can be produced at low cost but is very compact and is able to adapt to the operating frequencies used in communication, particularly to the frequencies required by DECT.

The purpose of the present invention is an antenna system with a diversity order of 2 integrated on an electronic card comprising a first radiating element of F-inverted type with a first extremity connected to a ground plane, a second extremity free and a conductive power supply part, a second radiating element of F-inverted type with a first extremity connected to a ground plane, a second extremity free and a conductive power supply part, characterized in that the free extremities of the first and second radiating elements are opposite one another and are separated by a projecting element of the ground plane.

According to an additional characteristic of the present invention, a slot is realised in the projecting element of the ground plane. Preferably, this slot which improves the decoupling, has a length of λg/4 where λg is the wavelength in the line at the operating frequency.

According to another additional characteristic of the present invention, a second slot and a third slot are realised in the ground plane of each side of the decoupling slot.

The second and third slots enable dimensions of the radiating element to be adapted to obtain an optimal radiation in the desired band of frequencies. In this way, a more compact system of antennas is obtained for a given frequency.

BRIEF DESCRIPTION OF THE DRAWINGS

Other characteristics and advantages of the present invention will emerge upon reading the following description of a preferential embodiment, this description being made with reference to the figure attached in the appendix, in which.

To simplify the description, the same elements have the same references as the figures.

DETAILED DESCRIPTION OF PREFERRED EMBODIMENTS

Figure 1:
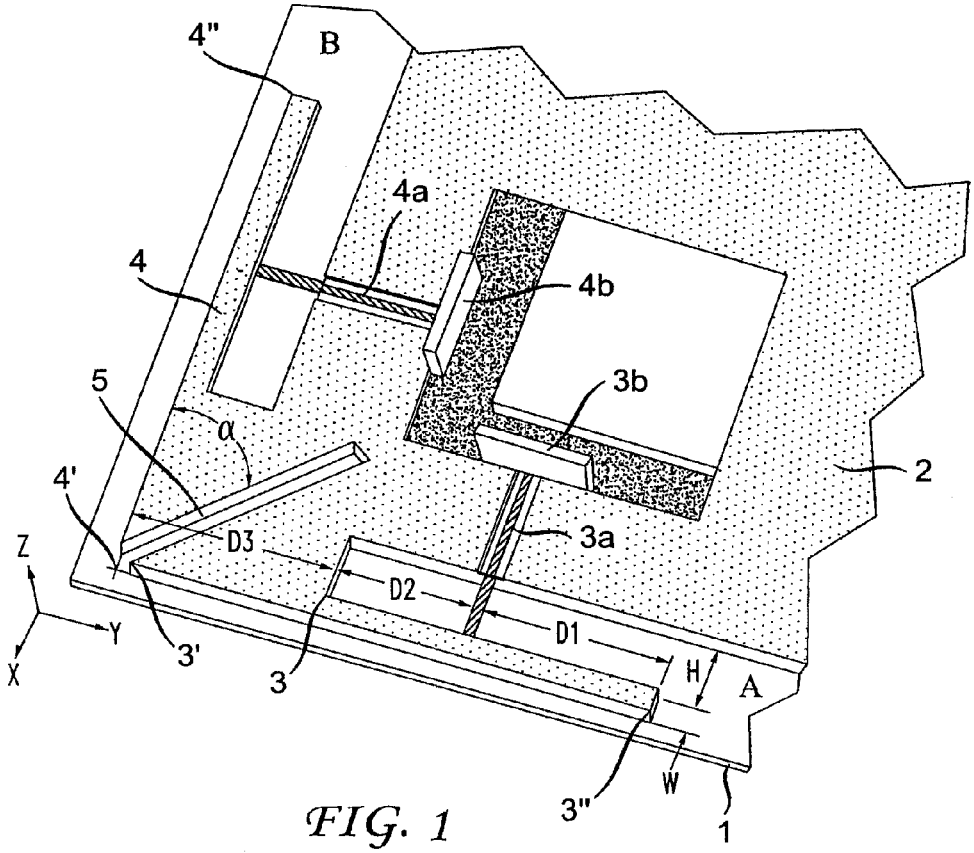
FIG. 1 (PRIOR ART)
FIG. 1 already described relates to an antenna system according to the prior art.
Figure 2:
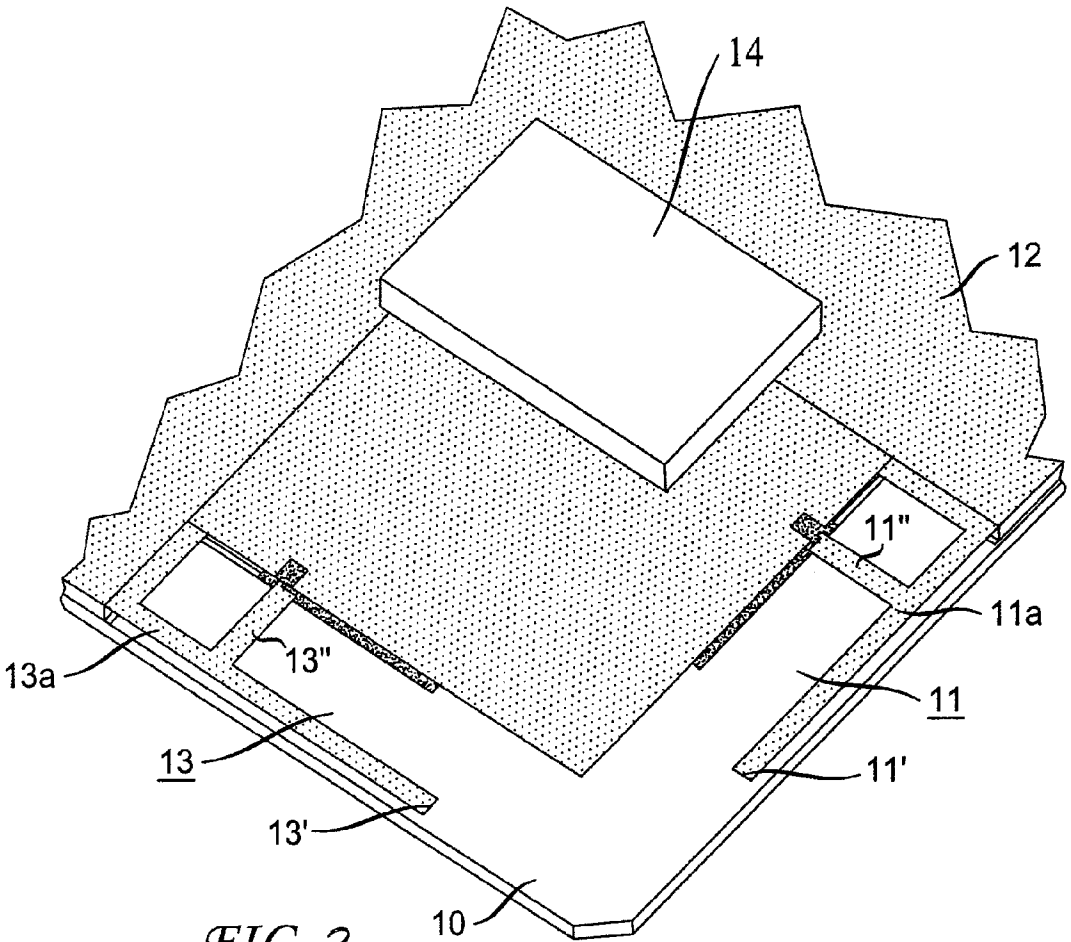
FIG. 2 is a diagrammatic perspective view showing an F-inverted type antenna system with two radiating elements.

With reference to FIG. 2, an embodiment of an antenna system comprising two F-inverted type radiating elements will now be described that overcomes the problem of the clearance area required for the correct operation of an antenna according to the prior art.

In this antenna, it is proposed to have the two free parts of an F-inverted type antenna face to face. However, it this antenna type reduces the total size of the antenna system, it does not resolve the problem well known to those skilled in the art of mutual coupling between the radiating elements.

As shown in FIG. 2, the antenna system is constituted by a first to radiating element 11 of F-inverted type etched on a substrate 10 with metallization 12. This first radiating element comprises a conductive arm 11*a* of which one extremity is connected to the ground plane 12 and for which the other extremity 11' extends towards a corner of the substrate 10. A second radiating element of F-inverted type 13 is realised in a similar manner to that of the element 11 but on a part of the substrate 10 perpendicular to that receiving the element 11. This F-inverted type element 13 also comprises a conductive arm 13*a* of which a part is connected to the ground and of which the other part 13' is free and opposite part 11'.

In this case, the arms 11*a* and 13*a* are connected by feed lines 11", 13" to electromagnetic signal processing circuits that can be positioned on the substrate 10, as shown by the element 14. This structure has the advantage of being particularly compact.

Figure 3:
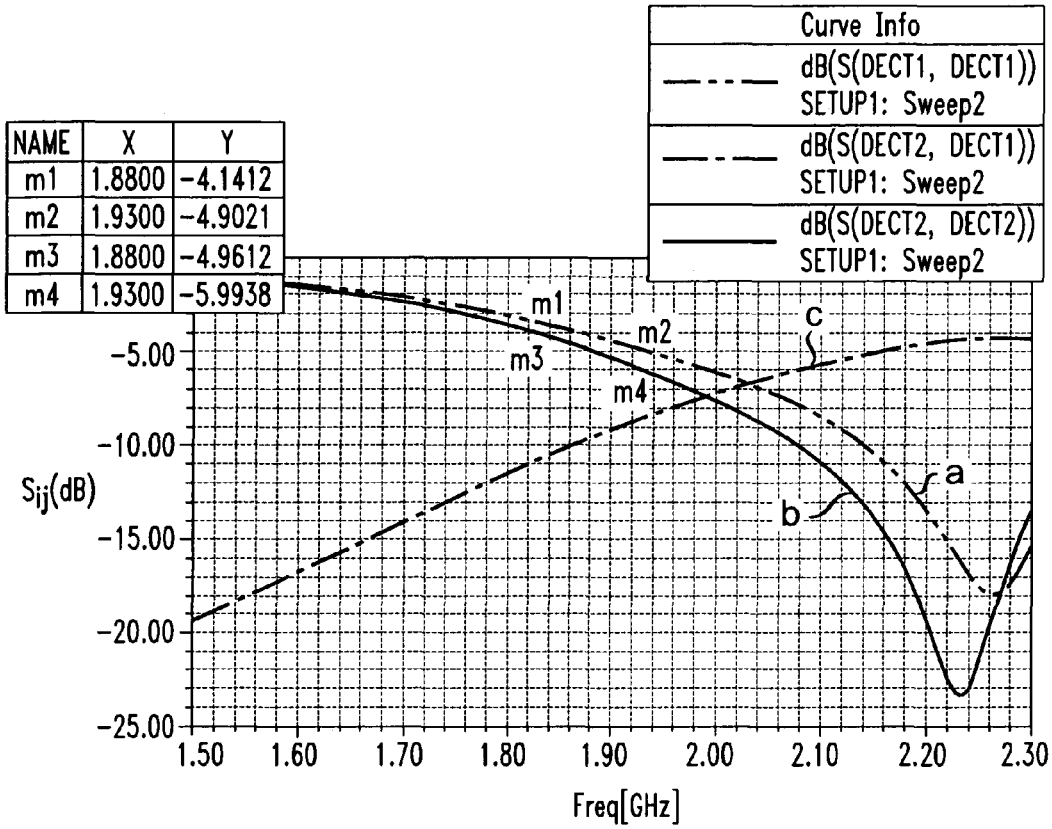
FIG. 3 shows the curves giving as a function of the frequency, the adaptation of each radiating element and the isolation between the two radiating elements of the antenna system of FIG. 2.

However, the simulations carried out on a structure of this type provided the adaptation curves a, b and the isolation curve c shown in FIG. 3. The isolation curve c shows a very strong mutual coupling between the radiating elements as known to those skilled in the art and does not enable a good diversity of order 2 to be obtained.

To overcome this disadvantage, while maintaining a good degree of compactness, the present invention proposes to integrate between the two free parts of the F-inverted type radiating elements, a projecting element 15 of the ground plane. This projecting element is in the form of a finger of a length compatible with the maximum size of the two antennas. Preferably, this projecting element has a slot 16 for which the length D4 is calculated so that D4 is noticeably equal to $\lambda g/4$ where $\lambda g$ is the guided wavelength in the metallic projecting element. Moreover, the minimum widths of the slots and the metallic parts of the finger are related to technological constraints. They have typically a width in the order of 150 μm.

According to another characteristic of the present invention, two slots 17, 18 are realised in the ground plane 12 each side of the decoupling slot 16.

Figure 6:
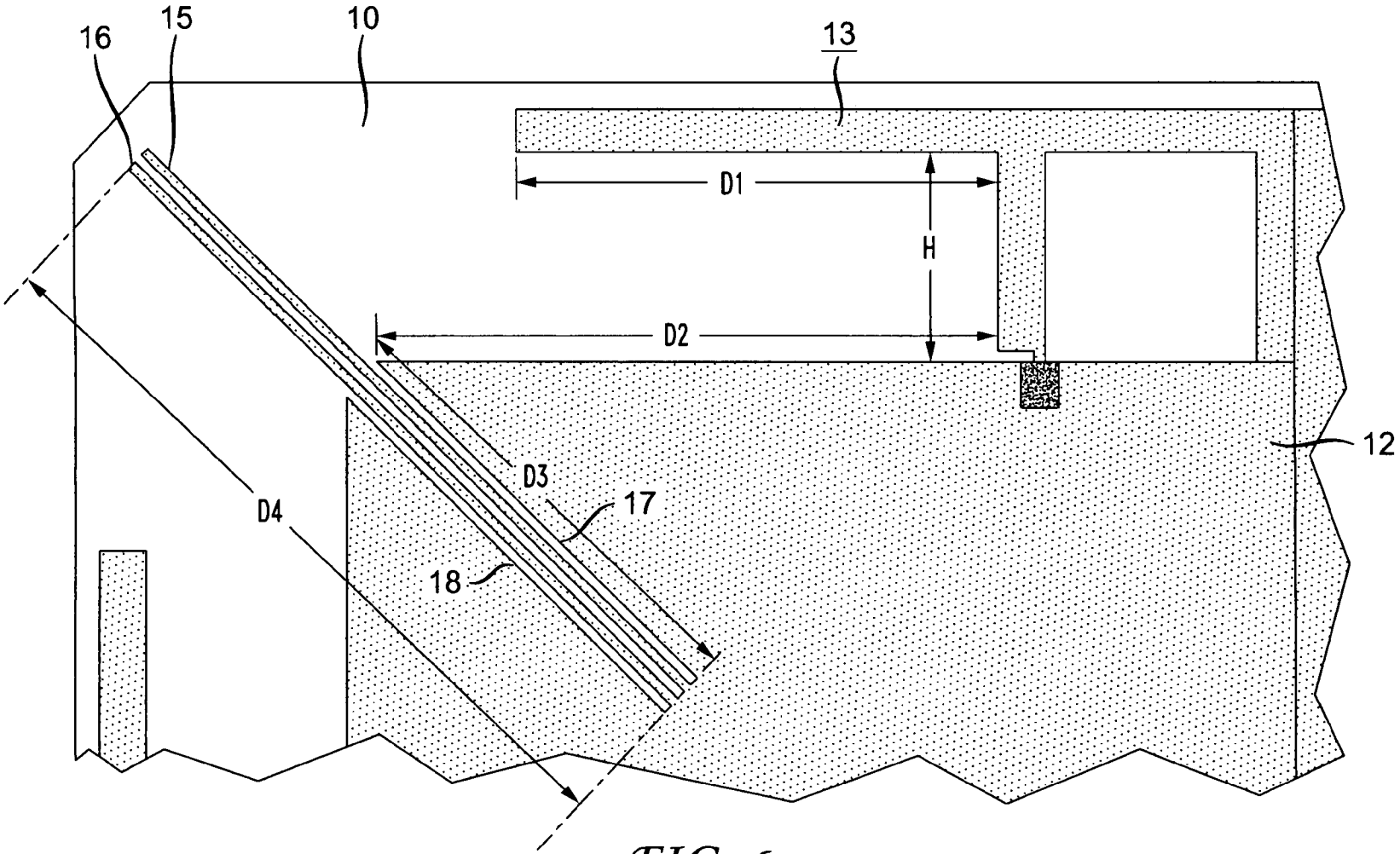
FIG. 6 is an enlarged top plan view, giving the different dimensions of a radiating element of the antenna in accordance with the present invention.

As shown in FIG. 6, the length L1 taken into account to calculate the operating frequency of the F-inverted type radiating element is then calculated in such a way that L1=D1+H+D2+D3+D4. The length D3 is thus selected to adapt the operating frequency of the F-inverted type radiating element.

Figure 4:
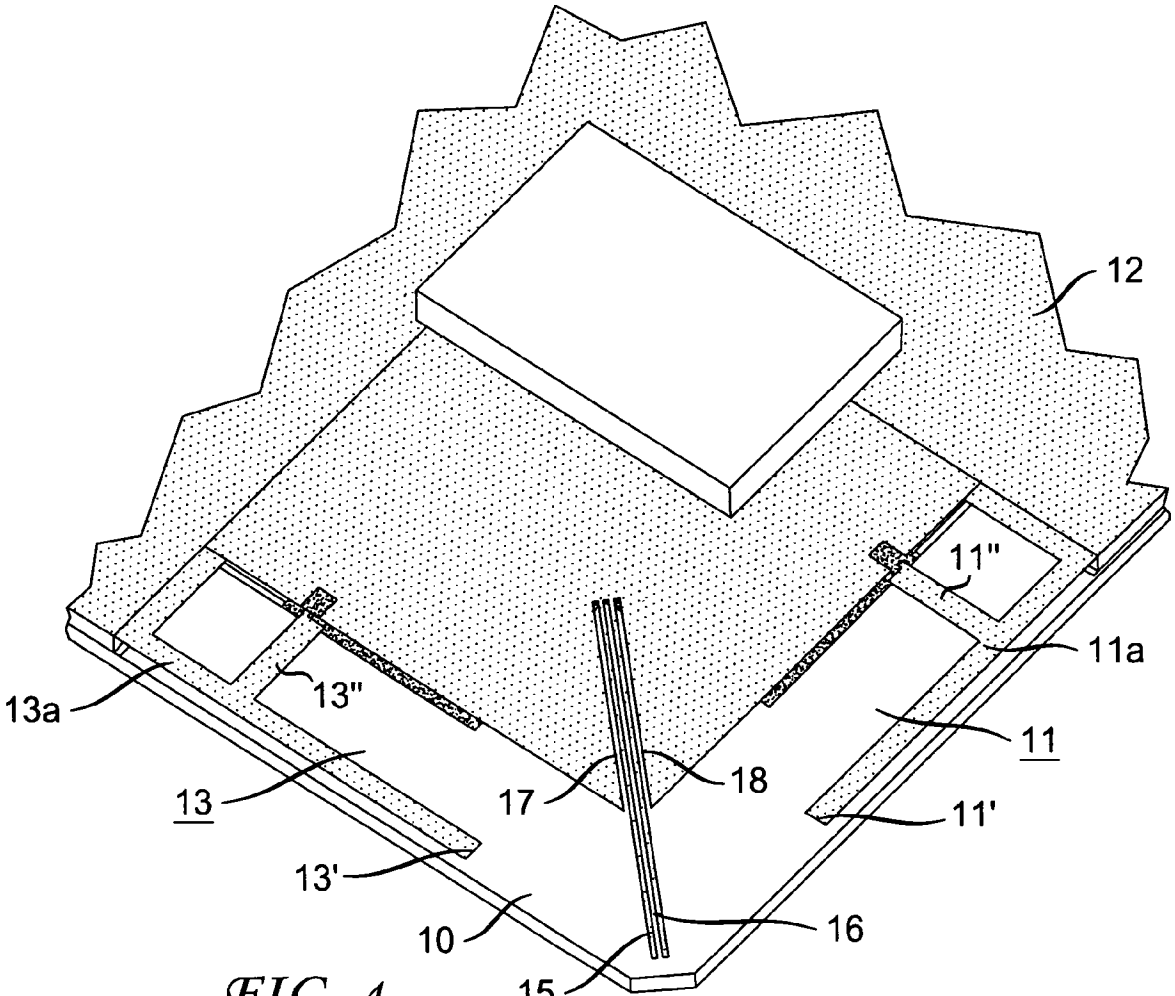
FIG. 4 shows in diagrammatic perspective an antenna system with an antenna diversity order of 2 in accordance with the present invention.

A 3D simulation, made using a HFSS Ansoft electromagnetic is simulator based on the finite element method, was carried out on an antenna system such as that described in reference to the FIGS. 4 and 6. In this case, the values selected are such that

D1=0.12 λ0
H=0.05 λ0
D2=0.155 λ0
D3=0.109 λ0
D4=0.188 λ0.

Figure 5:
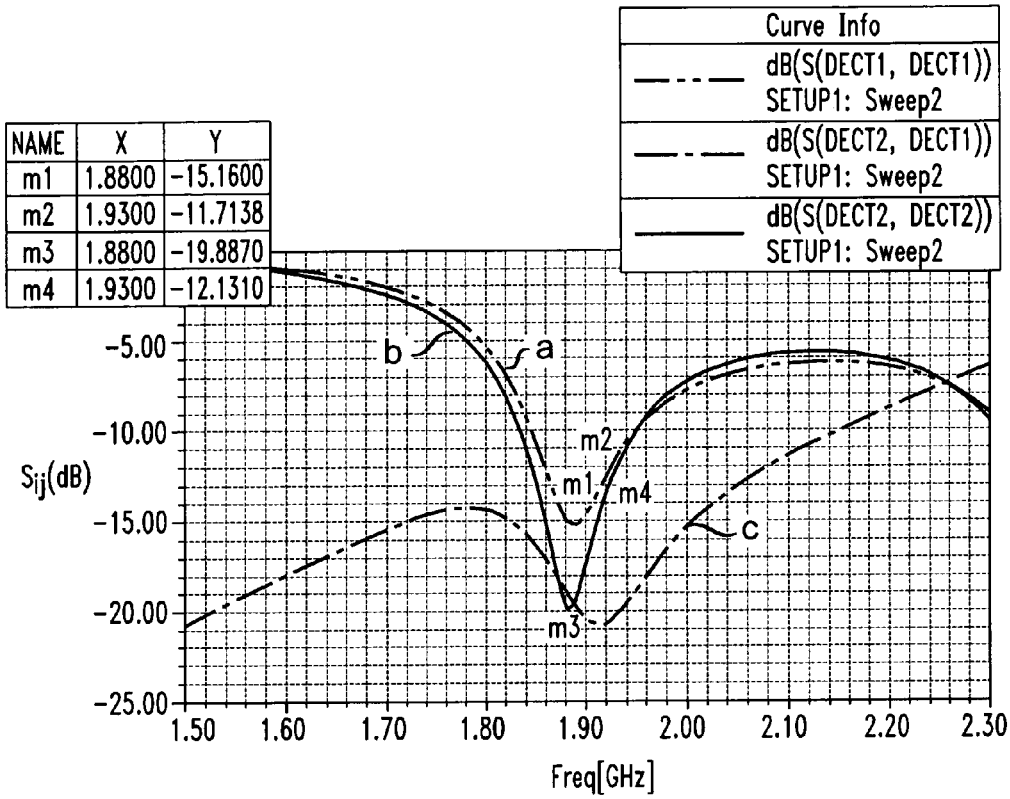
FIG. 5 shows simulation curves giving the adaptation of each radiating element and the isolation between the two radiating elements for the antenna system shown in FIG. 4.

These values were used in such a way to ensure operation in the band of frequencies comprised between 1.88 GHz and 1.93 GHz. The substrate used is a known substrate type namely FR4, with a thickness of 1.4 mm having a permittivity of $\epsilon r$=4.4 and a loss tangent of 0.03. The curves obtained in FIG. 5 show that the adaptation of each radiating element is less than −10 dB in the useful band (curve a, b) and that the isolation between the two radiating elements is less than −15 dB (curve c).

What is claimed is:

1. An antenna system with a diversity order of 2 integrated on an electronic card comprising on a substrate with a ground plane, said substrate comprising an area without the ground plane, the antenna system comprising:

a first radiating element of F-inverted type with a first extremity connected to said ground plane, a second extremity free and a conductive power supply part, a second radiating element of F-inverted type with a first extremity connected to said ground plane, a second extremity free and a conductive power supply part, and an element projecting upward from the substrate and extending from said ground plane into said are without the ground plane, said projecting element separating said first and second radiating elements;

wherein the free extremities of the first and second radiating elements are oriented to point toward one another in said area without the ground plane.

2. The antenna system according to claim 1, further comprising a first slot in the projecting element of the ground plane.

3. The antenna system according to claim 2, wherein said first slot has a length of $\lambda g/4$ where $\lambda g$ is the wavelength in the line at the operating frequency.

4. The antenna system according to claim 1, further comprising a second slot and a third slot in the ground plane on each side of the first slot.

* * * * *